US005326032A

United States Patent [19]

Quillin

[11] Patent Number: 5,326,032

[45] Date of Patent: Jul. 5, 1994

[54] LOW SPLASH STEADY STATE WATERFALL

[76] Inventor: Patrick Quillin, Box 700512, Tulsa, Okla. 74170-0512

[21] Appl. No.: 106,864

[22] Filed: Aug. 16, 1993

[51] Int. Cl.[5] ..... B05B 17/08

[52] U.S. Cl. ..... 239/20; 239/17

[58] Field of Search ..... 239/16, 17, 20, 23, 239/22, 18

[56] References Cited

U.S. PATENT DOCUMENTS

| | | | |
|---|---|---|---|
| 54,494 | 5/1866 | Bonham | 239/22 |
| 69,994 | 10/1867 | Hegarty | 239/23 |
| 3,008,646 | 11/1961 | Benak | 239/20 |
| 3,071,326 | 1/1963 | Benak | 239/23 |
| 3,451,622 | 6/1969 | Forney | 239/20 |
| 3,691,787 | 9/1972 | Kaufmann | 239/23 |
| 3,713,583 | 1/1973 | Gruber | 239/17 |

FOREIGN PATENT DOCUMENTS

| | | | |
|---|---|---|---|
| 3927500 | 2/1991 | Fed. Rep. of Germany | 239/17 |
| 425823 | 4/1911 | France | 239/17 |

*Primary Examiner*—Andres Kashnikow
*Assistant Examiner*—Christopher G. Trainor
*Attorney, Agent, or Firm*—John P. Halvonik

[57] ABSTRACT

A method for providing a minimal splash waterfall that provides a unique arrangement where by the system reaches a steady state of draining and refilling in each bowl with a pleasant falling water sound and minimal splashing. The waterfall has a number of bowls of decreasing diameter mounted above one another. Each of the bowls above the bottomost bowl has at least one hold in the bottom of each in order to drain the water from the top bowl to the bottom-most bowl with minimal splashing.

2 Claims, 2 Drawing Sheets

Fig. 2
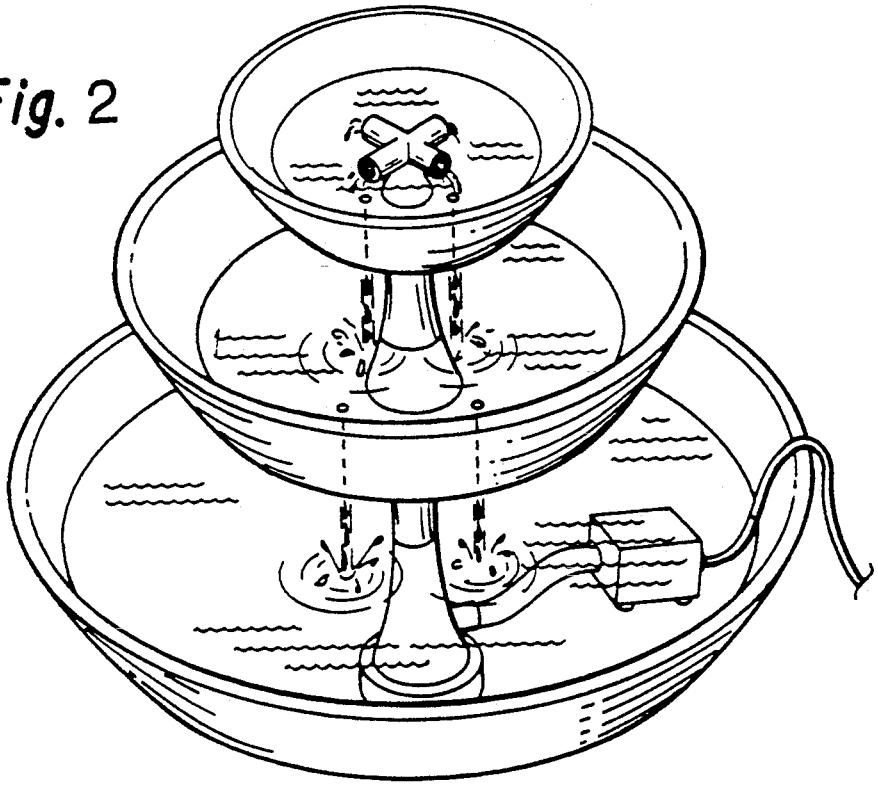
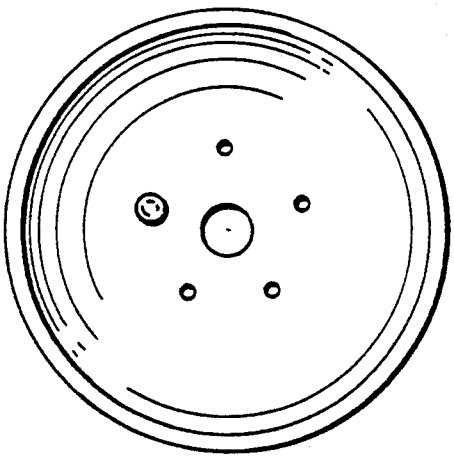
Fig. 3
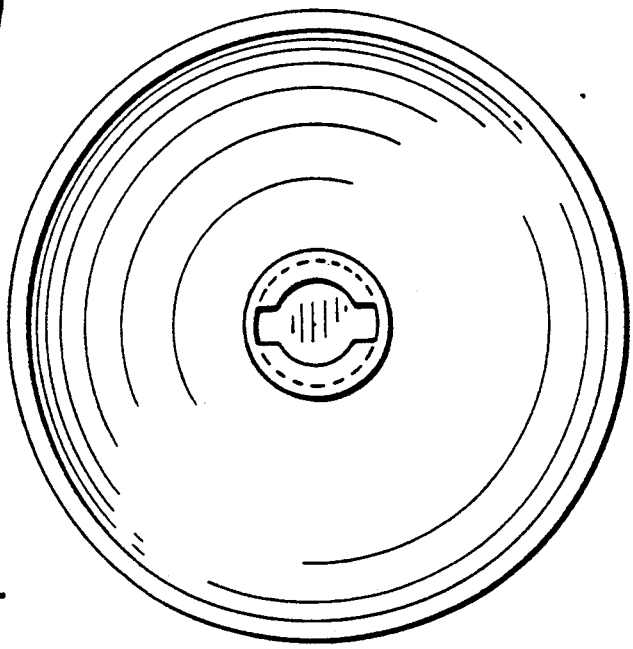
Fig. 4

LOW SPLASH STEADY STATE WATERFALL

BACKGROUND OF THE INVENTION

1. Field of the Invention

The invention relates to the field of waterfalls and in particular to a waterfall comprising a series of bowls mounted above one another and of decreasing radius as one moves in the upward direction. It is desirable to construct an indoor waterfall in order to provide a pleasant effect through the sound of falling water. Falling water also creates a form of "white noise" which obscures other noises, and provides a relaxing effect.

Most waterfalls are bulky, expensive and have an excessive amount of splashing caused by the water falling over the edges of each of the bowl in the fall. Excessive splashing is a problem in household waterfalls as this could cause water damage to indoor fixtures e.g. carpeting. Most current indoor fountains have a flow of water over the edge of the bowls in the system which results in quite a bit of splashing. It is believed that providing for flow of water near the center of each bowl and maintaining a steady state of volume in each bowl will result in an indoor waterfall with minimal splashing. By "steady state" it is meant that the volume of water in each bowl will remain virtually constant.

2. Prior Art While there are waterfalls that are known in the prior art, none that applicant is aware of that discharge near the center of each bowl.

SUMMARY OF THE INVENTION

A method and apparatus for providing a low-splash waterfall is described where the waterfall has a series of bowls mounted above one another including a bottom most bowl and a topmost bowl. The bowls are of decreasing radius in the upward direction with the topmost bowl being the smallest in diameter. Each of the bowls above the bottom most bowl has at least one aperture in the bottom of the bowl for providing a downward flow of water with minimal splashing. There is a pump means for pumping the water from the bottom most bowl to the topmost bowl for providing the downward flow of the waterfall.

It is an object of the invention to provide an indoor waterfall having a series of bowls mounted above one another and having apertures in the bottom of each bowl in order to decrease the amount of splashing of the waterfall.

It is another object of the invention to provide a low splash waterfall having a flow rate such that the level of water in each bowl will remain steady throughout the flowing of the waterfall.

Another object of the invention is to provide a low splash waterfall where the ratio of the height of intermediate bowls above one another is at least 3/2 that of the height of the water in each bowl in order to provide waterfall that will have a minimal amount of splashing.

Other objectives will become apparent to those skilled in the art once the invention is shown and described.

DRAWINGS

FIG. 1 Overall configuration of the low splash waterfall

FIG. 2 Optional weir shapes

FIG. 3 Top view of waterfall

FIG. 4 View of openings in the bottom of each bowl

DESCRIPTION OF THE PREFERRED EMBODIMENT

Figure 1:
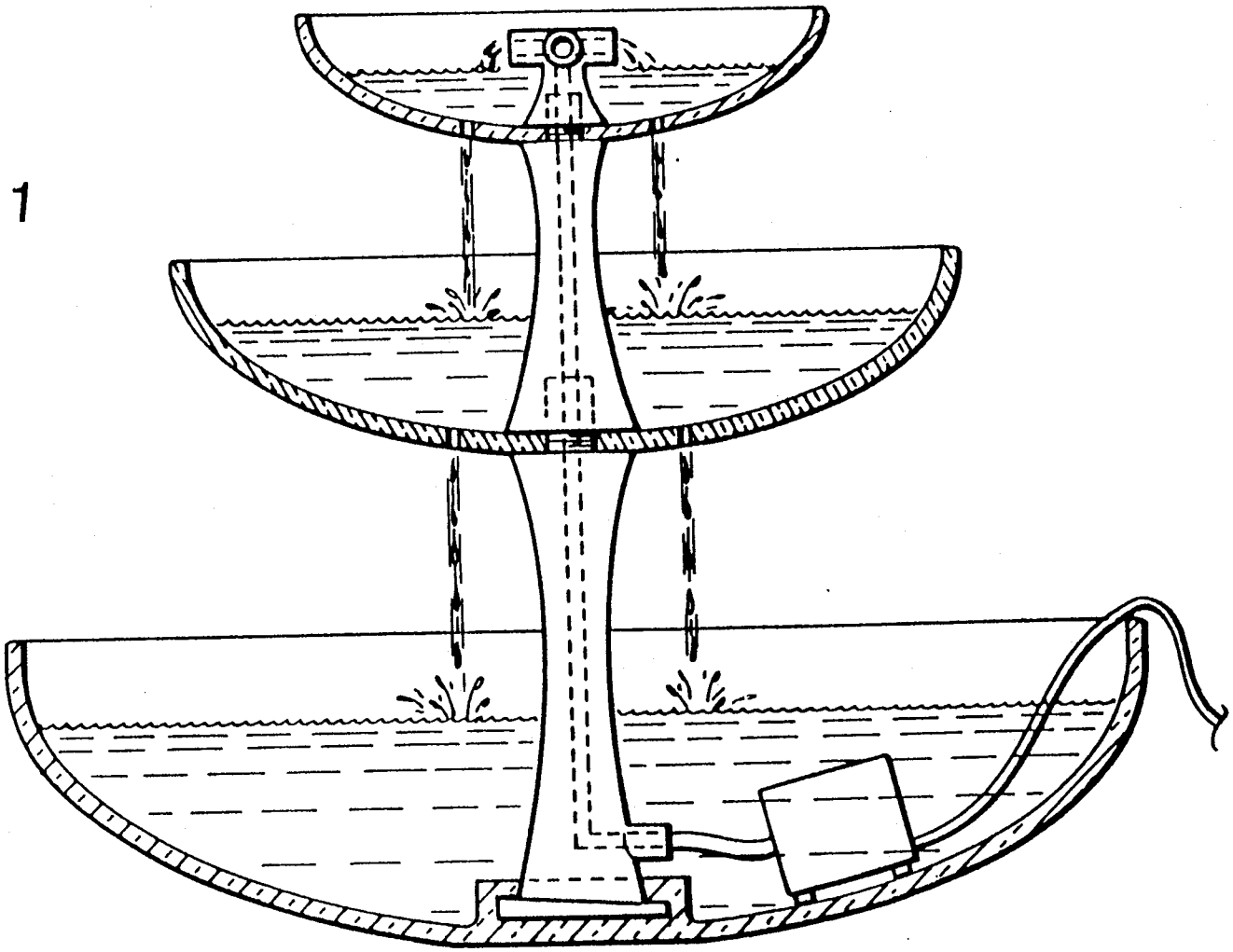

The overall configuration of the low splash waterfall is shown in FIG. 1. Bowls are mounted one above the other in order of decreasing diameter, the smallest diameter bowl being at the top. Each of the bowls above the bottom most bowl has at least one aperture near the bottom to insure that the flow of water is downward and near the center of each bowl.

These apertures in the bottom of each bowl should be so placed near the center of each that splashing will be confined to a minimum. As seen in FIG. 2–4 the apertures are placed near the center and preferably within a distance of about ½ of the radius from the center. That is, the apertures are within the inner half of the bowl. As the central part of each bowl is deeper than the sides the downward flow of water will be directed toward the deepest part of each bowl and splashing will be minimized. This construction of the waterfall insures that there will be a minimum of splashing of water.

By calculating the specific relationship between the depth of water in each bowl, the total surface area of the outlets at the bottom of each bowl, and the flow rate of the pump, it is possible to maintain each bowl nearly full of water and with a steady water level. This results in a minimum of splashing due to the central position of the downward discharging spouts and also the relatively large depth of water in each bowl will dampen the effect of the fall of the water above it.

The method must therefore provide enough flow of water through each of the bowls without overflowing each and, at the same time, providing enough water to maintain the level of water in each at a fairly safe depth to minimize splashing. Too much water and the bowls will overflow, not enough and the level in each will go down and splashing may increase. The bottom most bowl must have enough size to accommodate all of the water in the system when it is at rest (no water flowing) and have a desirable minimum depth when the water is in circulation.

It is found that there is a certain minimal size of bowl that is required to prevent splashing. This size is based on the ratio of distance from where the falling water hits the water in the bowl below to the edge of this bowl and the distance of the fall itself. This ratio must be at least 3:2, i.e. there must be at least 3 inches to the edge of the bowl (from where the water hits) for every 2 inches that the water falls.

The discharge coefficient will vary depending on the shape and means of connection of the orifice. For sharp edged orifices (e.g. a hole drilled in a flat surface in the bottom of each bowl) the discharge coefficient is equal to 0.61. Similar effects may be achieved by using a weir such as a V notch weir, a sharp crested weir and a Cipolletti weir, see FIG. 2.

I claim:

1. A minimal splash water fall having a series of bowls secured above one another for maintaining constant volume of water in each bowl, said water fall comprising: at least one intermediate bowl mounted above a bottom most bowl and a top-most bowl mounted above said intermediate bowl so as to form a series of bowls one above the other, said bowl of decreasing diameter from said bottom most bowl to said topmost bowl, said topmost bowl and said intermediate bowl having a radius R and a center, and each of said topmost and said intermediate bowls having at least one discharge opening for directing the fall of water, said discharge opening located within ½ R of said center of said topmost and intermediate bowls, said bottom most bowl in connection with a pump for bringing water to said topmost bowl at a rate suitable for maintaining a steady level of water in each bowl.

2. The apparatus of claim 1 wherein said intermediate bowl and said bottom-most bowl each have curved bottom surface such that each of said bowls is deepest at said center of each bowl.

* * * * *